US008100716B2

(12) United States Patent
Yahya et al.

(10) Patent No.: US 8,100,716 B2
(45) Date of Patent: Jan. 24, 2012

(54) ELECTRICAL CONNECTOR COMPRISING A SEALING MAT

(75) Inventors: Ould Yahya, Leves (FR); Bernard Brice, Villers Ecalles (FR); Jean François Michel, Yermenonville (FR); Nicolas Hermeline, Barjouville (FR)

(73) Assignee: FCI Automotive Holding, Guyancourt (FR)

( * ) Notice: Subject to any disclaimer, the term of this patent is extended or adjusted under 35 U.S.C. 154(b) by 0 days.

(21) Appl. No.: 12/735,025

(22) PCT Filed: Dec. 13, 2007

(86) PCT No.: PCT/IB2007/055399
§ 371 (c)(1),
(2), (4) Date: Jun. 10, 2010

(87) PCT Pub. No.: WO2009/074850
PCT Pub. Date: Jun. 18, 2009

(65) Prior Publication Data
US 2010/0273353 A1 Oct. 28, 2010

(51) Int. Cl.
*H01R 13/52* (2006.01)

(52) U.S. Cl. ..... 439/587

(58) Field of Classification Search ..... 439/587, 439/275, 274, 271, 588, 589
See application file for complete search history.

(56) References Cited

U.S. PATENT DOCUMENTS 5,634,807 A * 6/1997 Saito ..... 439/275

FOREIGN PATENT DOCUMENTS

EP 1 296 415 A1 3/2003
WO WO 2006/108442 A1 10/2006

OTHER PUBLICATIONS

Product Release, "GE Achieves New Benchmark in Low Compression Set with Latest Generation of Liquid Silocone Rubber", GE Silopren LSR 3596/30, Leverkusen, Germany, Jun. 12, 2006, 2 pgs.

* cited by examiner

*Primary Examiner* — Alexander Gilman
(74) *Attorney, Agent, or Firm* — Harrington & Smith

(57) ABSTRACT

Electrical connector including a sealing mat made of a deformable material body having a thick portion and a thin portion having: an upper face a lower face parallel to the upper face, hollow passageways extending along a longitudinal axis from the upper face to the lower face, a housing including a receiving portion, a grid including a compression portion, the sealing mat being compressed between the receiving and compression portions.

8 Claims, 3 Drawing Sheets

ELECTRICAL CONNECTOR COMPRISING A SEALING MAT

FIELD OF THE INVENTION

The instant invention relates to electrical connectors comprising sealing mats (also called "grommets" or joint).

BACKGROUND OF THE INVENTION

EP 1 296 415 already describes such a connector, which is globally satisfactory. However, one always strives to improve the retention of the electrical members or terminals and the sealing ability of mats in normal use, in particular around the cables connected to the terminals, while ensuring an easy insertion of the terminals through the mat and maintaining low the risk of damaging the mat during this insertion.

One of the objects of the instant invention is notably to provide such an improvement.

SUMMARY OF THE INVENTION

To this aim, the invention provides an electrical connector according to claim 1.

The sealing ability is then improved while the insertion of electrical members through the mat is kept easy.

In some embodiments, one might also use, independently or in combination, one or more of the features as defined in the dependant claims.

BRIEF DESCRIPTION OF THE DRAWINGS

Other characteristics and advantages of the invention will readily appear from the following description of one of its embodiments, provided as a non-limitative example, and of the accompanying drawings.

On the drawings.

On the Figures, the same references designate the same or similar elements.

DETAILED DESCRIPTION

Figure 1:
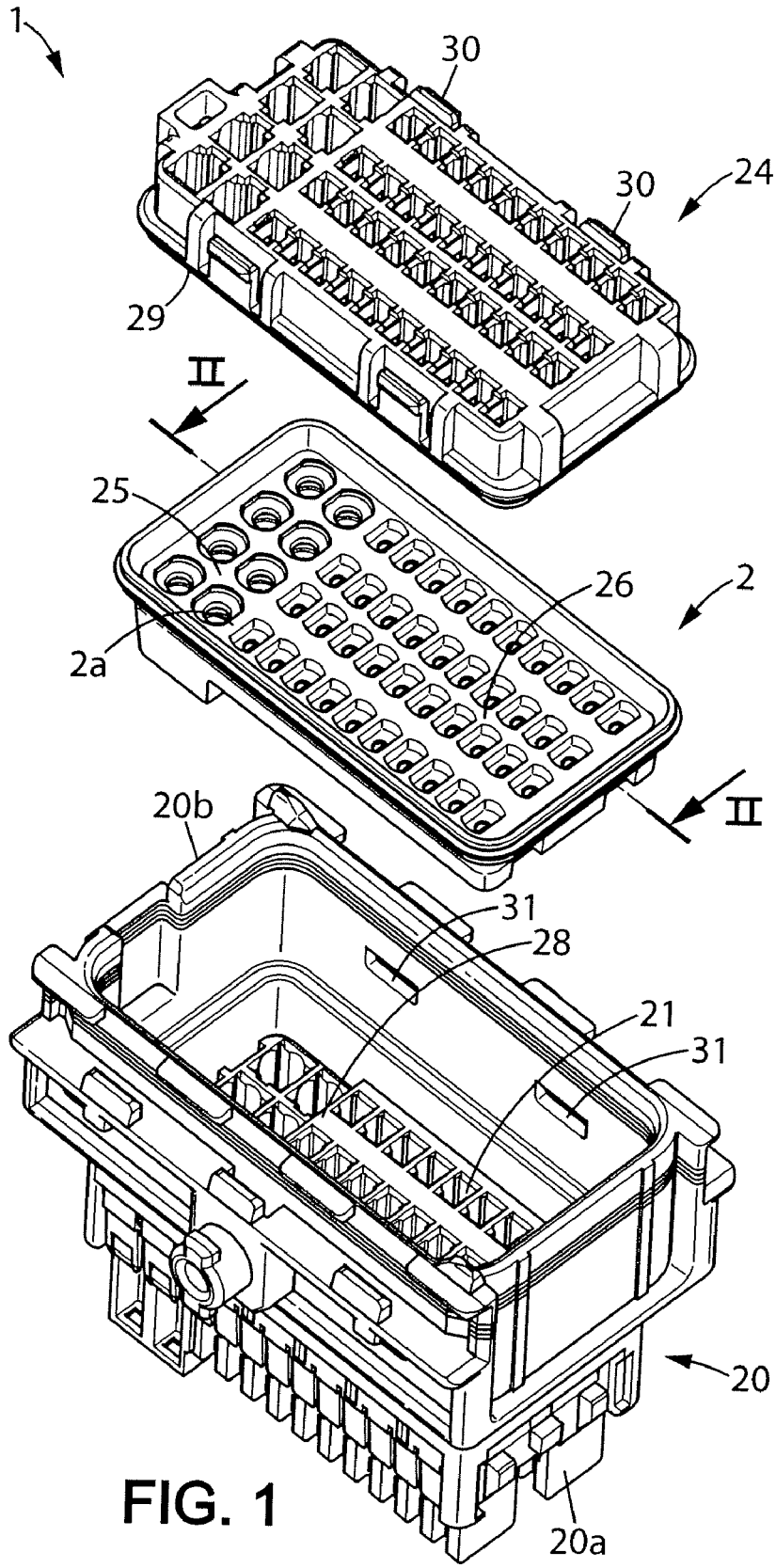
FIG. 1 is an exploded view of a connector shown without any electrical connection member.

FIG. 1 is an exploded view of an electrical connector 1. This connector comprises a housing 20 made of an electrically insulating material such as glass-fiber reinforced polybutylene terephtalate (PBT). The housing comprises a front part 20*a* (bottom of FIG. 1) arranged in columns and rows of passageways 21 for receiving electrical connection members which will be described in further details below. The housing also comprises a back part 20*b*, for receiving a sealing mat 2 and a grid 24 each of which comprising passageways corresponding to the passageways 21 of the housing.

A sealing mat 2 is inserted between the front part 20*a* of the housing and the grid 24. The sealing mat will be described later in more details with reference to FIG. 2.

The sealing mat 2 is for example made of a soft deformable quasi incompressible material such as Liquid Silicone Rubber. A suitable example could be a material provided by GE-Bayer under reference Silopren 3596/30 (30 Shores A). The above material also has an auto-lubricating property provided by an oil content of 5%, thereby facilitating the contact insertion.

Depending on the application requirements, other materials such as Heat Curing Rubers (HCR), Silicone or Ethylene Propylene Diene Monomers (EPDM), thermoplastic elastomers (ETP), or others, could also be used for the sealing mat 2.

Figure 2:
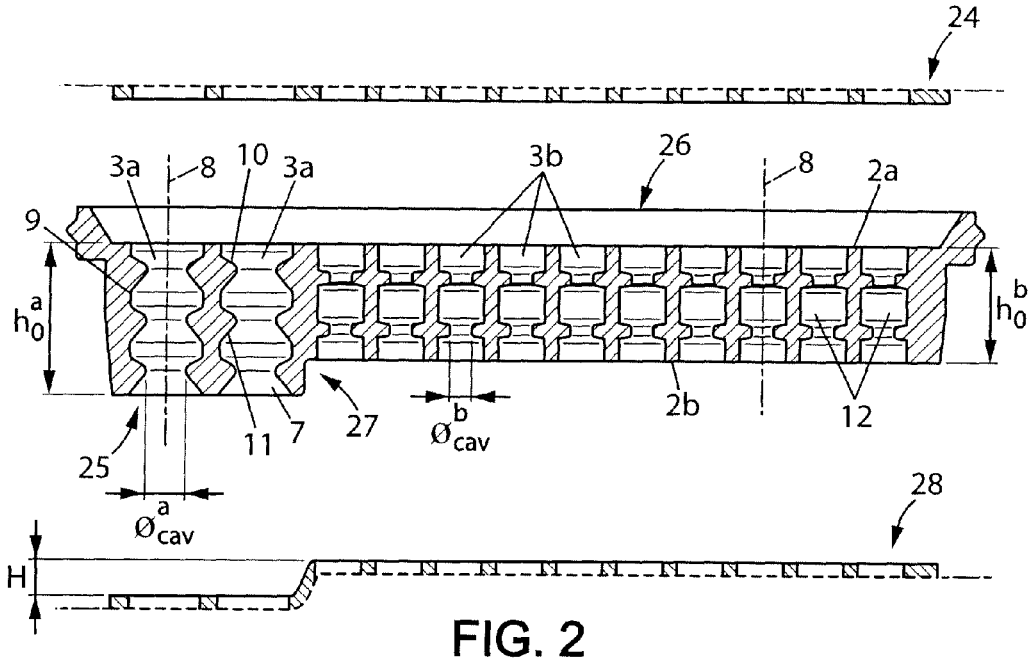
FIG. 2 is a partial exploded sectional view along line II-II of FIG. 1 of the electrical connector of FIG. 1.

FIG. 2 is a sectional view of the sealing mat along the insertion direction, along line II-II of FIG. 1.

The sealing mat 2 comprises an upper face 2*a* for insertion of the electrical members and an opposing lower face 2*b*. In the described example, two series 3*a*, 3*b* of passageways are defined in the sealing mat, a first series comprising broad passageways 7 of minimal diameter $\Phi_{cav}{}^{a}$ about 1.50 mm for receiving thick electrical connection members for insertion into broad passageways of the housing, an a second series comprising narrow passageways 12 of minimal diameter $\Phi_{cav}{}^{b}$ about 1.00 mm for receiving thin electrical connection members for insertion into small passageways of the housing. The dimensions of the sealing mat, the number of series and the number, positions and sizes of passageways of the sealing mat and of the grid are related to the passageways of the housing, depending on the application required for the connector. The dimensions, positions and sizes pictured on FIG. 2 are only exemplary and could vary from one sealing mat to another.

In the portion 25 of the sealing mat where the openings are broader, namely on the left side in the present embodiment, the thickness $h_0{}^{a}$ of the sealing mat, measured from the upper face 2*a* to the lower face 2*b*, is larger than the thickness $h_0{}^{b}$ on the portion 26 where the openings are narrow.

For example, as shown, the extra-thickness is provided at the bottom face of the joint whereas the upper face is continuously flat (the upper faces of the two portions are flush). In another embodiment, the extra-thickness may be provided on the top face, the bottom faces being flush. In yet another embodiment, extra thickness may be provided, in the left portion, both on the upper and the lower faces.

In the present example, the electrical member 4*a* of a female connector comprises a terminal portion 22 inserted into the passageway 21 of the front part 20*a* of the housing, for connection with a mating male contact.

This terminal portion extends from a cable element 5 which comprises an insulating sheath 6 which extends through the housing to the outside of the housing. The sheath 6 comprises a first junction portion 6*a* located proximate to the terminal portion, and a more remote external portion, or sheath body, designed to extend outside of the connector for connection to another electric equipment. In this example, the proximate junction portion 6*a* is somehow cylindrical, and exhibits a diameter $\Phi_{cab}{}^{a}$.

Figure 3:
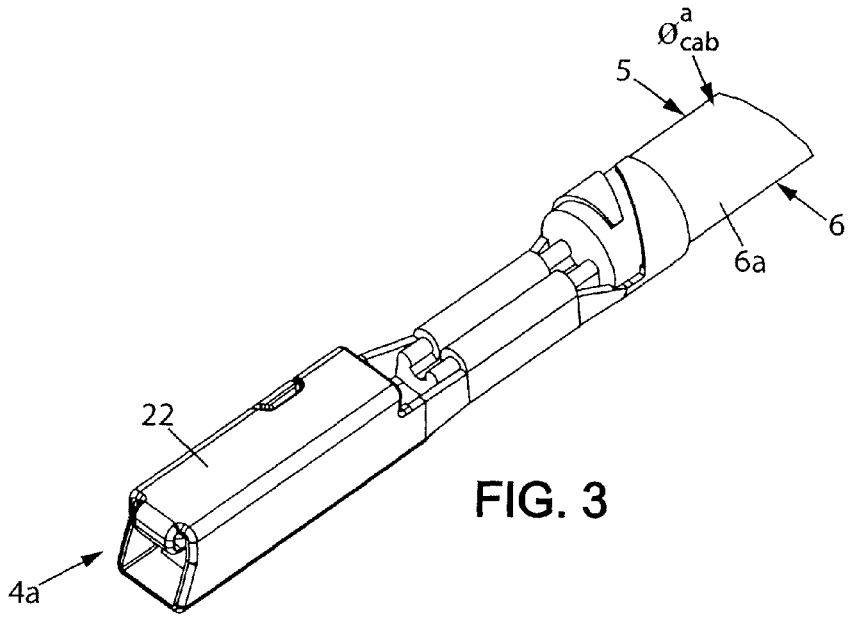
FIG. 3 is a perspective view showing an example of an electrical connection member for the electrical connector of FIG. 1.

The characteristic dimension of cables is in fact the section of the conductor and not the external diameter of the cable (conductor+insulating sheath). Indeed, the thickness of the insulating sheath varies according to the cable manufacturer and/or the national standard. FIG. 3 shows an electrical member for insertion through a broad passageway 7. A smaller electrical member, inserted through a narrow passageway 12, has a diameter $\Phi_{cab}{}^{b}$ less than $\Phi_{cab}{}^{a}$. According to the ISO standard, 0.3 $mm^2$ copper wires have a 1.30 mm external diameter. According to the ISO standard, 0.5 $mm^2$ copper wires have a 1.55 mm external diameter. According to the ISO standard, 1 $mm^2$ copper wires have a 1.90 mm external diameter. A compression ratio can be defined as $$r_\Phi = \frac{\Phi_{cab}}{\Phi_{cav}} - 1.$$

In the example embodiment, the contacts to be inserted in the broad passageways 7 have a somehow rectangular section of 2.40 millimetres (mm) times 2.70 mm.

The axisymmetric passageways 7, 12 extend for example axisymmetrically about a symmetry axis 8 from the insertion face 2*a* of the sealing joint to the extraction face 2*b* of the sealing joint. Consequently, the electrical connection member is to be inserted from the top of FIG. 2. The passageways 7, 12 are defined by an axisymmetric wall 9, from which projects a first lip 10, and for example another lip 11. 4, i.e. the passageways comprise at least one ring-shaped rib 10 or 11 along said longitudinal axis.

Other lips could be present in the passageway.

A membrane could also be disposed so as to close the circle formed by a lip, said membrane being torn at insertion of the contact member.

Figure 5:
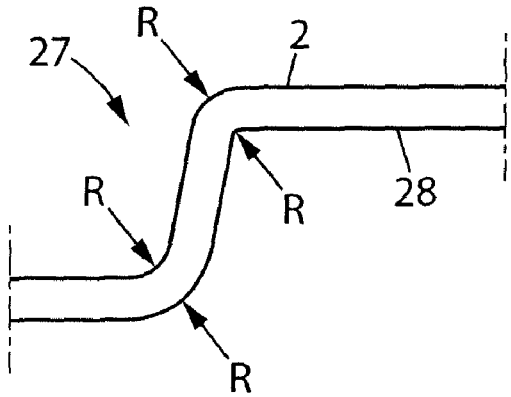
FIG. 5 is an enlarged view of the stress-relief region for an example embodiment.

At the junction between the thin and thick portion of the sealing mat, a stress-relief shape 27 is provided to prevent the building of the high stress when compressing the sealing mat. For example, the shape 27 is rounded and/or inclined as shown on FIG. 5 and forms a step having rounded edges between two adjacent portions having a curvature R equal or greater than 0.2 mm.

The sealing mat has been described above in a rest uncompressed condition, where no stress is applied on the sealing mat. In use, when the grid 24 is locked on the housing 20, by cooperation of the locking lances 30 with the locking apertures 31, the sealing joint is maintained in a compressed condition between a compression portion 29 of the grid and a receiving portion 28 of the housing by the mechanical cooperation of the grid 24 and the back part 20*b* of the housing (the upper part of the housing on FIG. 1). The sealing mat thus applies pressure on the sheath of the electrical contact members and provide the sealing ability. In the present example where the extra-thickness is provided at the bottom face of the joint, the receiving portion 28 is also stepped for accommodating the sealing mat. In the compressed condition, the thickness of the thick portion is defined as $h^a$, and the thin portion one as $h^b$. Then a thickness ratio is defined as $$r_h = 1 - \frac{h}{h_0}.$$

Figure 4:
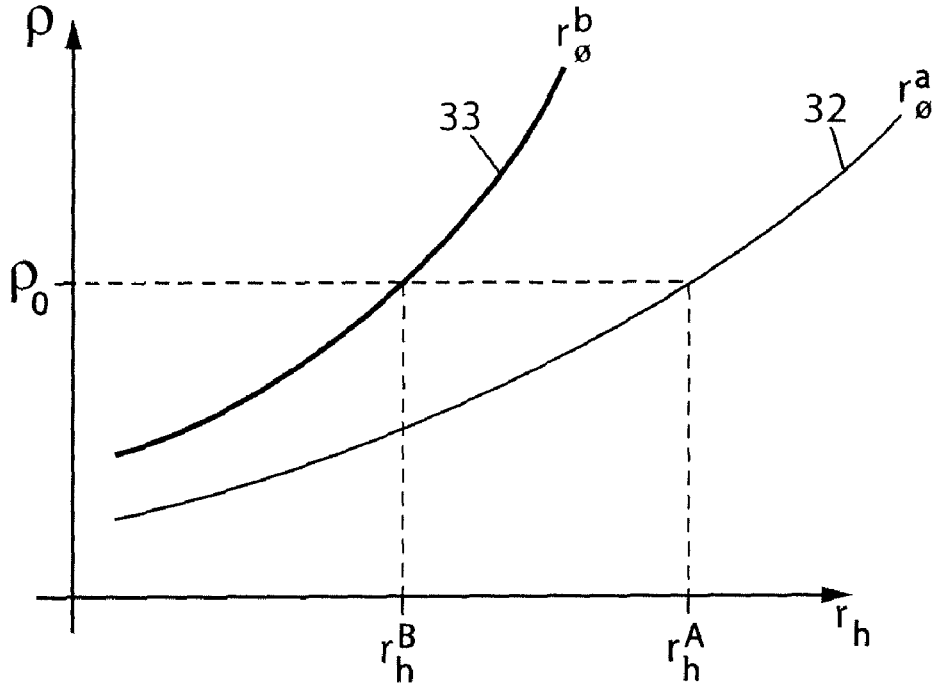
FIG. 4 is a graph showing the relationship between sealing ability and thickness ratio for passageway/cable systems of various compression ratio.

FIG. 4 is a graph showing in abscissa, the thickness ratio $r_h$ and in ordinate, the sealing ability, expressed as the force or average pressure exerted by the sealing mat or grommet on the cable. The relationship between the sealing ability and the thickness ratio $r_h$ is shown by a curve 32 for a first passageway/cable system having a first compression ratio $r_\Phi{}^a$, and by a curve 33 for a second passageway/cable system having a second compression ratio $r_\Phi{}^b$.

As shown, in order to have a uniform sealing ability $\rho_0$ among the different passageway/cable systems (preferably, the sealing ability among the systems varies by less than 10%, preferably by less than 5% and most preferably by less than 2%), it is necessary to use a thickness ratio $r_h{}^A$, for the systems having the first compression ratio $r_\Phi{}^a$, which is larger than the thickness ratio $r_h{}^B$ for the systems of second compression ratio $r_\Phi{}^b$. If, for example, before compression the large passageways 7 have an initial compression ratio $r_\Phi{}^a$ of 22.5% (e.g. a passageway having a 1.55 mm internal diameter, with 1 $mm^2$ cross section wire and a 1.90 mm external diameter), and the narrow passageways 12 have a compression ratio $r_\Phi{}^b$ of 30% (e.g. a passageway having a 1.00 mm internal diameter, with 0.3 $mm^2$ cross section wire and a 1.30 mm external diameter), after for example a 0.80 mm compression for a 17% thickness ratio, the internal diameter of the large passageway would decrease to 0.95 mm and the internal diameter of the narrow passageway would decrease to 0.64 mm. Then, we obtain a final compression ratio (in the compressed state) equal to 99% and 103% for the large passageway and the narrow passageway respectively.

A connector with a homogeneous sealing ability can thus be defined.

It is readily understood that different thickness ratios in the different areas will automatically mean that the height H of the step of the receiving portion 28 will be different than the difference of thickness between the thick and thin portion of the mat.

It should be noted that the number, arrangement and sizes of the passageways in the present description is by way of illustration only. Further, there might be more than two portions of different thicknesses and/or the step(s) could be performed on the grid rather than or in addition to the step on the housing.

The invention claimed is:

1. Electrical connector comprising:

a one-piece sealing mat made of a deformable material body having, in a rest condition of the mat in which no stress is applied on the mat, a thick portion and a thin portion each having:

an upper face a lower face parallel to said upper face, at least one hollow passageway, in each one of the thick portion and the thin portion, extending along a longitudinal axis from said upper face to said lower face for sealant reception therein of an electrical member, the longitudinal axis of the passageway of the thick portion being parallel to that of the thin portion, the thickness of the thick portion, measured along said longitudinal axis, being greater than that of the thin portion, and a stress-relief feature at a junction of the thick and thin portion, to prevent formation of a high-stress region in the sealing mat in a compressed condition, a housing for reception of the electrical members for connection to a complementary connector, the housing comprising a receiving portion, and a grid comprising a compression portion facing the receiving portion of the housing, the grid being locked to the housing so that the sealing mat is compressed between the receiving and compression portions.

2. Electrical connector according to claim 1, wherein the at least one hollow passageway of the thick portion is a broad passageway, and wherein the at least one hollow passageway of the thin portion is a narrow passageway.

3. Electrical connector according to claim 1, wherein the upper face of the thick portion and the upper face of the thin portion are flush.

4. Electrical connector according to claim 1, further comprising:

a large electrical contact member comprising a terminal portion and a cable portion extending through the passageway of the thick portion and having a thick cross-section, a small electrical contact member comprising a terminal portion and a cable portion extending through the passageway of the thin portion and having a thin diameter.

5. Electrical connector according to claim 4, wherein the compression ratio in the thick portion is different from the compression ratio in the thin portion, and wherein the thickness ratio in the thick portion is different from the thickness ratio in the thin portion so that the sealing ability in the thick portion differs by less than 10%, preferably by less than 5% from the sealing ability in the thin portion.

6. Electrical connector according to claim 1 wherein the receiving portion is stepped.

7. Electrical connector according to claim 1 wherein the compression portion is stepped.

8. Electrical connector comprising:

a one-piece sealing mat made of a deformable material body having, in a rest condition of the mat in which no stress is applied on the mat, a thick portion and a thin portion each having:

an upper face a lower face parallel to said upper face, the thick and thin portions respectively having a plurality of broad passageways and a plurality of narrow passageways extending along a longitudinal axis from said upper face to said lower face for sealant reception therein of an electrical member, the longitudinal axis of the passageways being parallel to each other, the thickness of the thick portion, measured along said longitudinal axis, being greater than that of the thin portion, and a stress-relief feature at a junction of the thick and thin portion, to prevent formation of a high-stress region in the sealing mat in a compressed condition, a housing for reception of the electrical members for connection to a complementary connector, the housing comprising a receiving portion stepped for accommodating the mat, with a step having rounded edges having a curvature equal or greater than 0.2 mm, a grid comprising a compression portion facing the receiving portion of the housing, the grid being locked to the housing so that the sealing mat is compressed between the receiving and compression portions.

* * * * *